US011358181B2

(12) United States Patent
Zbinden

(10) Patent No.: US 11,358,181 B2
(45) **Date of Patent: *Jun. 14, 2022**

(54) EXTENDABLE CLEANING DEVICE FOR ELECTRICAL INSULATORS

(71) Applicant: Adam Jon Zbinden, Kirkland, WA (US)

(72) Inventor: Adam Jon Zbinden, Kirkland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/407,100

(22) Filed: Aug. 19, 2021

(65) Prior Publication Data

US 2021/0379626 A1 Dec. 9, 2021

Related U.S. Application Data

(63) Continuation-in-part of application No. 16/875,248, filed on May 15, 2020, now Pat. No. 11,148,174.

(51) Int. Cl.
*B08B 1/00* (2006.01)
*H01B 17/52* (2006.01)

(52) U.S. Cl.
CPC ..... *B08B 1/001* (2013.01); *H01B 17/52* (2013.01); *B08B 2240/00* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 1,568,408 | A * | 1/1926 | Miles | H02G 1/02 | 15/21.1 |
| 2,856,625 | A * | 10/1958 | Delacretaz | A47L 4/02 | 15/244.1 |
| 3,409,925 | A * | 11/1968 | Bodine, Jr. | B08B 3/12 | 15/97.1 |
| 4,435,874 | A * | 3/1984 | Jacobson | A47L 4/02 | D4/122 |
| 5,119,851 | A * | 6/1992 | Paris | H02G 1/02 | 134/172 |
| 5,201,090 | A * | 4/1993 | Jans | B08B 1/04 | 15/88.4 |
| 5,448,793 | A * | 9/1995 | Mallory | A47L 1/06 | 15/232 |
| 8,261,401 | B1 * | 9/2012 | Ciesielski | A47L 4/02 | 15/104.93 |
| 11,148,174 | B1 * | 10/2021 | Zbinden | B08B 1/006 | |
| 2020/0061676 | A1 * | 2/2020 | Chundi | B08B 1/04 | |

* cited by examiner

*Primary Examiner* — Erin F Bergner

(57) ABSTRACT

A cleaning device for high voltage transmission and distribution insulators, featuring orthogonally oriented scrubbing and wiping attachments for the simultaneous cleaning of perpendicular surfaces, which extend to an insulator surface from telescoping support prongs, which are supported by a handle which provides a gripping location for manual operation of the present invention.

1 Claim, 5 Drawing Sheets

EXTENDABLE CLEANING DEVICE FOR ELECTRICAL INSULATORS

BACKGROUND OF THE INVENTION

Electrical insulators play a vital role in the high voltage power transmission and distribution system. They maintain electrical isolation between energized equipment and earth ground potential. When insulators fail, catastrophic flashover can occur, resulting in potential damage to the system. One contributing factor leading to insulator failure is dirt or dust accumulation on the insulator disc surfaces. Particles at sufficient concentrations will form a conductive path, which the energized conductor can provide fault current to, resulting in current flowing over and along the insulator disc surfaces. This unintended current flow, resulting from surface particles which have sufficiently low resistivity to conduct current at the insulator's rated line voltage, will mechanically stress the insulator material, leading to premature mechanical failure of the insulator, as seen by a reduction of measured insulation resistance to inoperably low levels.

For the cleaning of post insulator structures, which feature stacks of discs, accessing the inter-disc region for cleaning purposes can be challenging. The concave regions between the insulator discs can accumulate particles and retain them despite initial cleaning efforts. A device which can efficiently, and completely clean bushing insulators is desirable, using glass cleaning methods which are adapted to the geometry of a bushing insulator.

SUMMARY OF THE INVENTION

The proposed device has several advantages for maintenance personnel tasked with cleaning insulation discs. The device has multiple prongs and will clean a minimum of 3 to 4 insulation discs at a time. It can be operated with one hand, which can be significant if working at heights. It introduces solvent and scrubs the insulator disc surface, with the spongiform side of its head, and then wipes and squeegees the surface with the rubber bladed side. In cooperation with a belt-mounted solvent container for continual refreshing of the sponge, the device can exhaustively clean large stacks of insulators in minimal amounts of time, optimizing the routine of an important electrical maintenance task. It can also be constructed of electrically insulating materials, such that the device is rated to operate safely at high voltages. It thus offers improvements in speed, efficiency, and safety relative to existing methods for cleaning high voltage insulator discs. The cleaning device also maintains a degree of separation between the maintenance personnel and the insulator discs, which is advantageous because it is electrically insulated and protects the user from high voltage sources, and protects the fragile nature of the often-glass insulator discs from inadvertent damage, as all contact surfaces on the device are soft and deforming. The cleaning attachments must extend sufficiently far from the support prong member to which they are attached, such that the inter-disc void regions of the insulator stack are completely covered with cleaning attachment surfaces, while the handle, support prongs, and junction member are free to travel in device-actuating cleaning movements around the insulator and surrounding equipment without physical clearance issues.

DETAILED DESCRIPTION OF THE INVENTION

Figure 1:
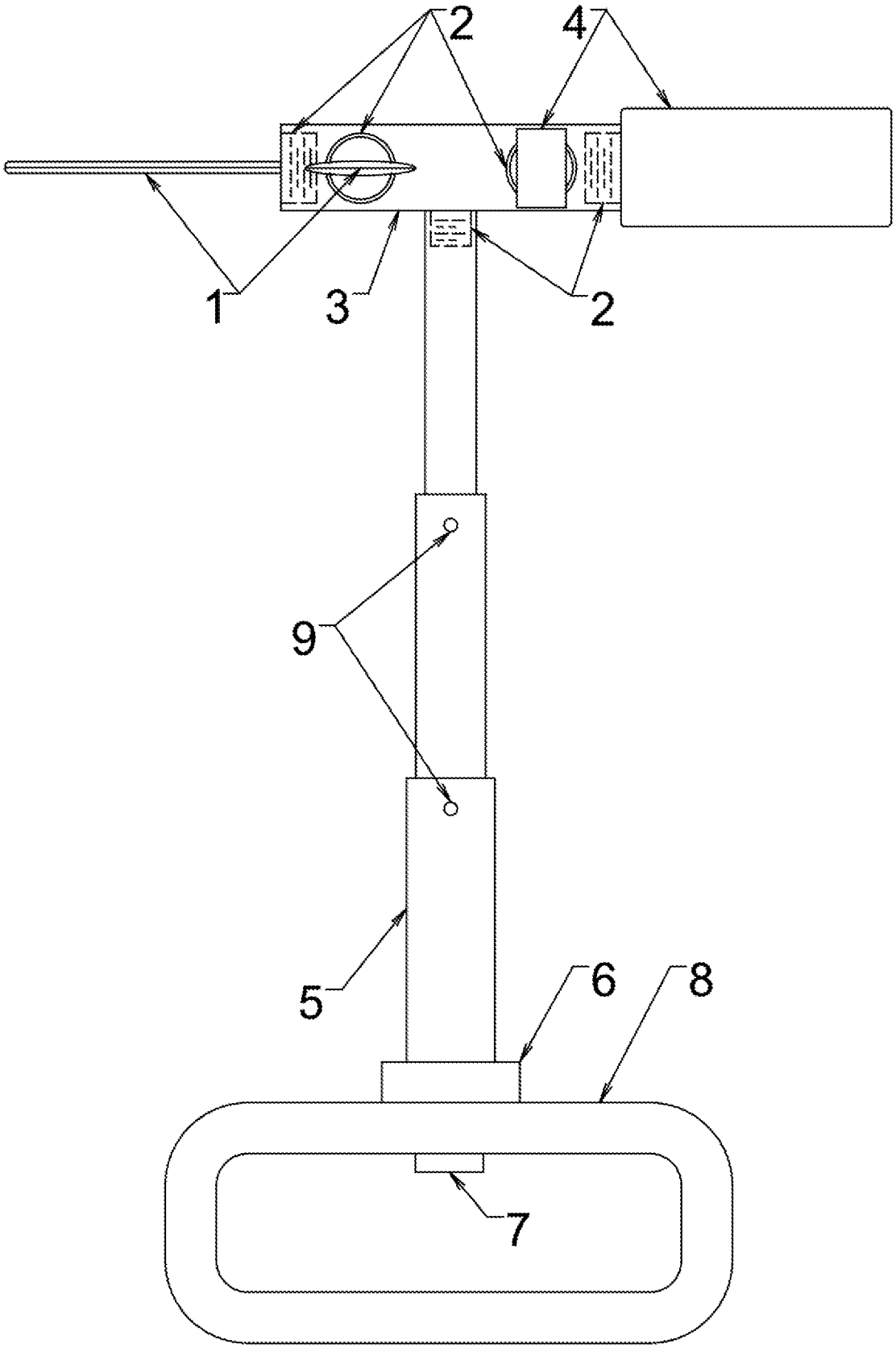
FIG. 1 is a top view of the device, where (1) is a flexible rubber blade attachment which wipes glass surfaces, (2) is a threaded connection port between the cleaning attachments and the rest of the device, (3) is the branching head which connects with (1) and the spongiform cleaning attachment (4) and which extends from the rigid support prong (5) which is telescoping to be extendable and retractable, based on the nested and segmented shell structure of (5) and the prong segment positional retainer buttons shown with (9). The support prong (5) bonds with the junction member (6), where the handle (8) attaches to the junction member (6) with the swivel bushing (7).
Figure 2:
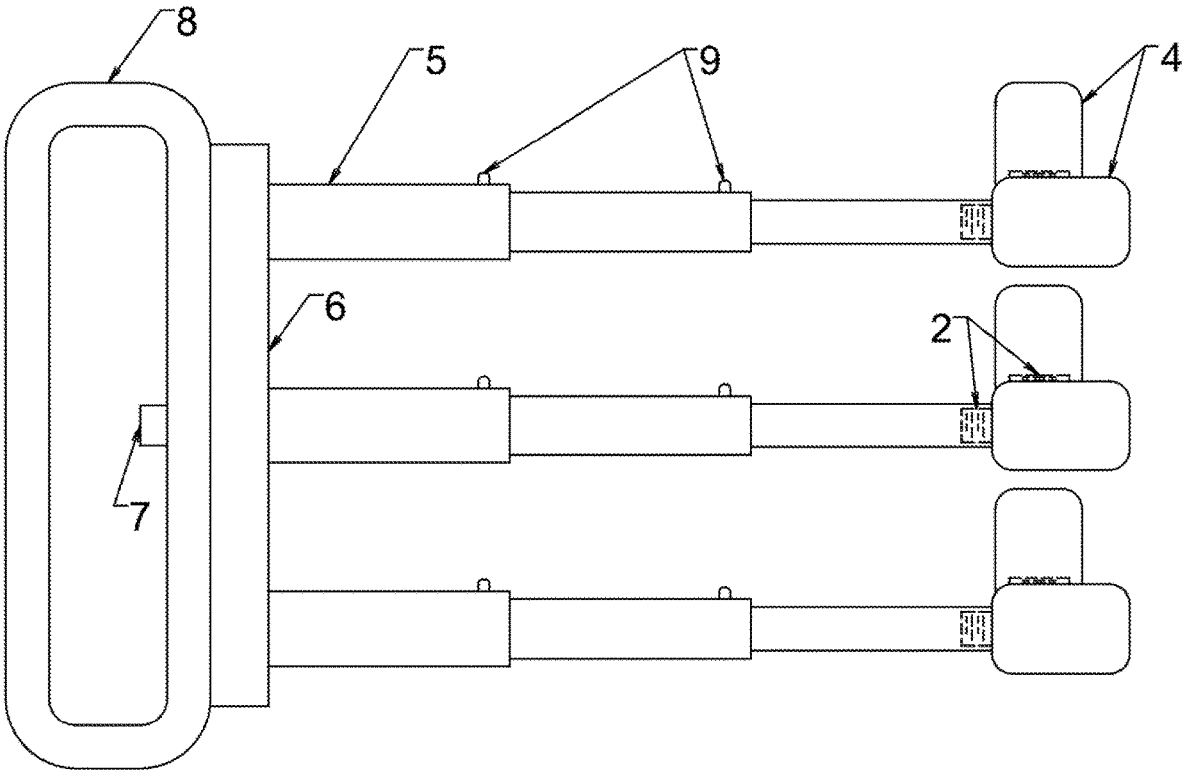
FIG. 2 is a side-view of the device, to show the perpendicular orientation of the blades (1) and sponges (4) relative to the rigid telescoping support prong (5), (9), while the handle (8) is shown in a different orientation from FIG. 1 due to the swivel action of the adjustable bushing mechanism (7) about the junction member (6).
Figure 3:
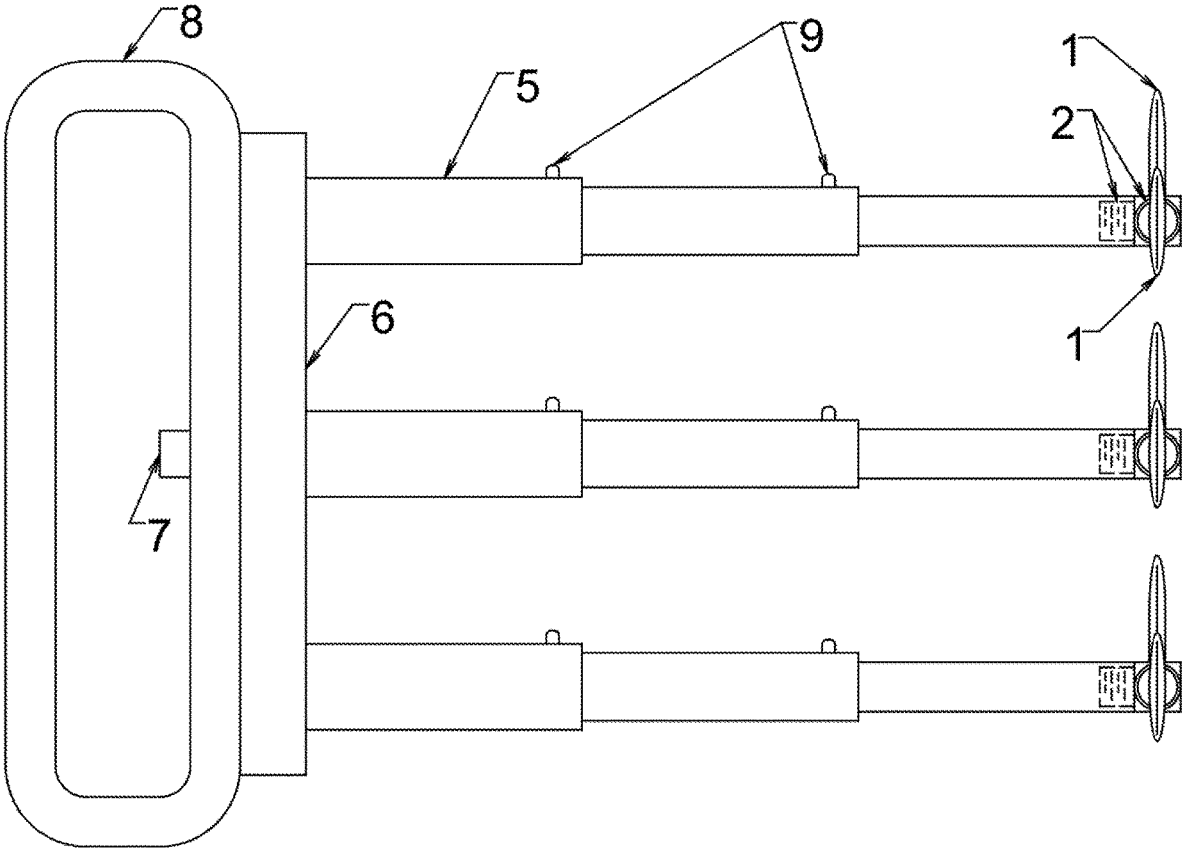
FIG. 3 is a front view of the device, again showing the perpendicular and orthogonal orientation of the blade cleaning attachment (1) and the spongiform cleaning attachment (4) with respect to the rigid support prong (5). The connection ports (2) show the interface between (1),(4) and the branched head (3), which allows for interchanging of cleaning attachment parts. The diagonal orientation of the handle (8) shows the potential for the handle to spin in all directions relative to the rest of the device.
Figure 4:
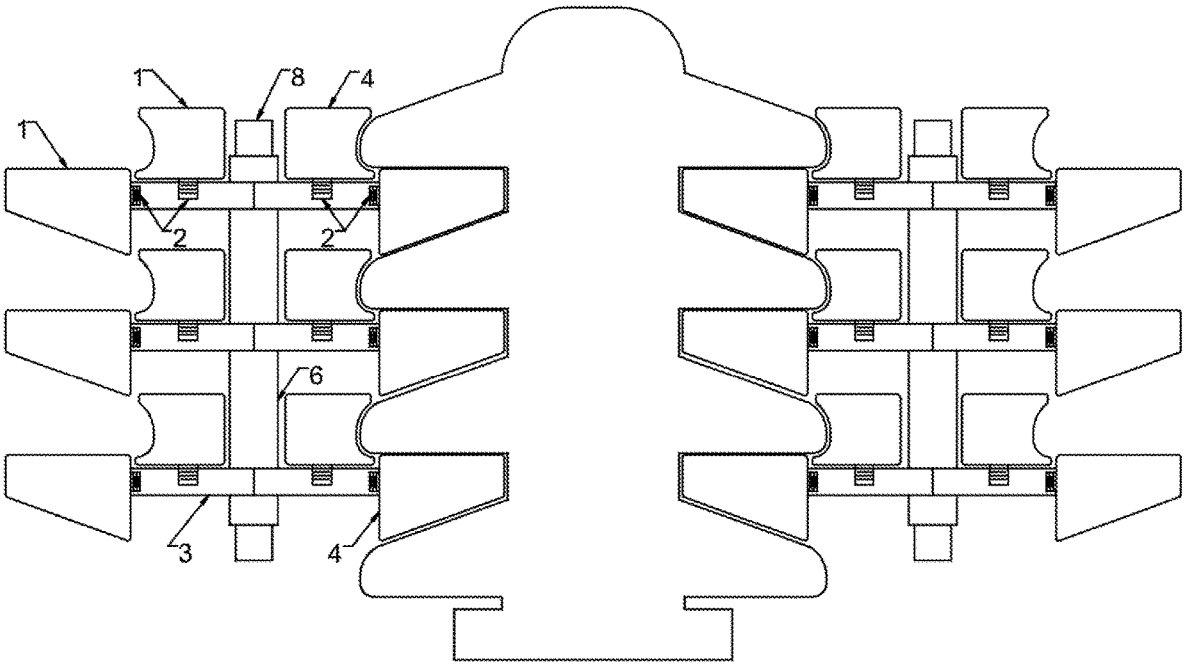
FIG. 4 demonstrates the potential for placement of the cleaning sponges and cleaning disks in the interstitial regions of the insulator disks, to cover the total surface area of the disk insulators when the device is swept in an angular motion around the insulator, in a concentric circle around the center of the disks while making full contact between the cleaning sponge or disk and the insulator surface as viewed from the front of the device, facing the cleaner attachments.
Figure 5:
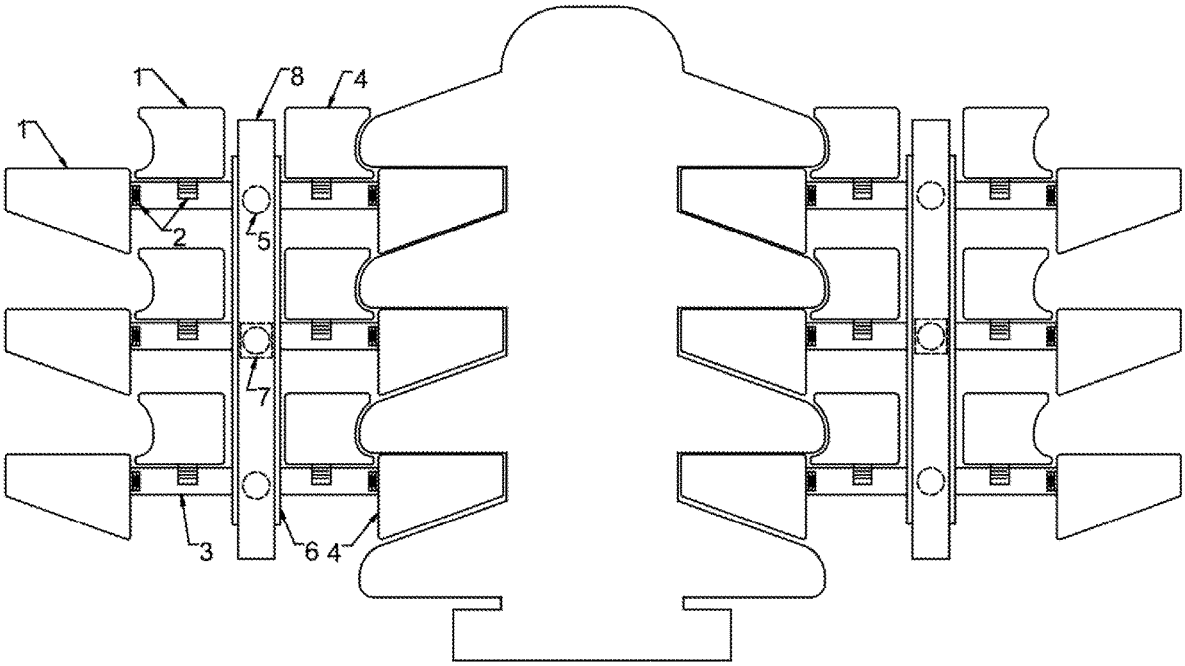
FIG. 5 demonstrates the potential for placement of the cleaning sponges and cleaning disks in the interstitial regions of the insulator disks, to cover the total surface area of the disk insulators when the device is swept in an angular motion around the insulator, in a concentric circle around the center of the disks while making full contact between the cleaning sponge or disk and the insulator surface as viewed from the front of the device, facing the handle, where the attachment points of the telescoping, extendable & retractable support prongs to the junction member are shown dashed and circular, forward of the handle which is the foremost component in the layering structure.

The device is intended to be constructed of non-conducting polymer, such that it has a high overall insulation rating. Maintaining the electrical non-conductivity of the device is critical to its design, such that no metallic materials would be used for its construction. Thermo-welded plastic may be used to create the geometry specified in the design, where the cleaning attachments can be changed out according to insulator design, where the inter-disc regions will have different surface geometry for the attachments to conform to.

The cleaning attachments (1) and (4) extend away from the connection ports (2) and the branched head (3) of the support prong (5) so that (1) and (4) completely fill the inter-disc region and the device can be actuated without physical clearance issues relative to the insulator stack. The device can be operated in either a push or pull manner, as the rigid support prong (5) will transmit force in either direction relative to the handle (8) and the prong junction member (6). The junction member (6) has connection points for the ends of the rigid prong (5), such that at least three prongs are equidistantly spaced along the junction member (6) which is linked with the handle (8) through an adjustable swivel bushing mechanism (7). This allows the handle to turn in any direction relative to, and along a parallel axis with, the cleaning attachments when (1),(4) are cleaning within the inter-disc region. The support prongs (5) have a nested shell structure which allows a telescoping property of extension and retraction using the positional retainer buttons shown with (9). As each cleaning attachment pair is supported by an individual telescoping support prong, the number of cleaners deployed to the insulator disk surface is variable, such as for small detailing tasks where only one may be needed. Additionally, the possibility of adjusting the length of the telescoping support prongs allows for reaching elevated or distant insulators which could otherwise be unreachable due to access or clearance issues.

The invention claimed is:

1. An electrically insulated and multi-pronged cleaning device which conforms to the surfaces of stacked electrical insulator discs of a high voltage power transmission and distribution system to simultaneously dean multiple insulation discs, the cleaning device for their wet cleaning, having cleaning agent application and removal capabilities, comprising:

a handle piece comprising of a loop;

a prong junction member, which connects to said handle, and which has at least three equidistant bolted or welded hardware connections along its length;

at least three rigid and extending support prongs, wherein each of the at least three prongs comprises a segmented and nested shell structure, with a positional retainer button located on each segment, wherein each extending support prong attaches respectively to one of the hardware connections on the prong junction member at a first end of the support prong, and each support prong having a head at a second end, opposite the first end, wherein each head branches to have two first threaded attachment ports oriented orthogonal to each other, and two second threaded attachment ports oriented orthogonal to one another and oppositely oriented from the first threaded attachment ports;

wherein each first threaded attachment port is attached to a corresponding flexible rubber bladed cleaner attachment, and each second threaded attachment port is attached to a corresponding liquid absorbent cleaner attachment to form right angle cleaning surfaces, on opposite sides of each branching head.

* * * * *